US006010184A

United States Patent [19]

Lee et al.

[11] Patent Number: 6,010,184

[45] Date of Patent: Jan. 4, 2000

[54] CHILD SUPPORT DEVICE WITH REMOVABLE SEAT ELEMENT

[75] Inventors: Greg Lee, Brecksville, Ohio; John A. Helmsderfer, 2151 Luray Ave., Cincinnati, Ohio 45206

[73] Assignee: John A. Helmsderfer, Cincinnati, Ohio

[21] Appl. No.: 09/024,699

[22] Filed: Feb. 17, 1998

[51] Int. Cl.[7] ..... A47C 13/00; A47D 1/00

[52] U.S. Cl. ..... 297/130; 297/440.22; 297/256.16; 297/236; 297/134; 297/118

[58] Field of Search ..... 297/130, 118, 297/440.22, 237, 236, 134, 447.4, 256.16, 256.17, 251

[56] References Cited

U.S. PATENT DOCUMENTS

| | | | |
|---|---|---|---|
| D. 387,583 | 12/1997 | Shear . | |
| 1,267,800 | 5/1918 | Peterrman | 297/134 |
| 2,244,096 | 6/1941 | Brazell | 297/134 |
| 2,731,072 | 1/1956 | Post | 297/134 |
| 3,427,069 | 2/1969 | McDonald | 297/40 |
| 4,065,175 | 12/1977 | Perego | 297/130 |
| 4,743,063 | 5/1988 | Foster, Jr. . | |
| 5,248,181 | 9/1993 | Efthmiou . | |
| 5,421,636 | 6/1995 | Gamble . | |
| 5,470,039 | 11/1995 | Hilger . | |
| 5,527,096 | 6/1996 | Shimer . | |
| 5,564,778 | 10/1996 | Shimer et al. . | |

OTHER PUBLICATIONS

Cosco, Inc.,*Cosco Commerical Contract Products—Youth Seating*, Cosco Sales Brochure for Model 03–341 High Chair.

*Primary Examiner*—Anthony D. Barfield
*Attorney, Agent, or Firm*—Wood, Herron & Evans, LLP

[57] ABSTRACT

A multi-purpose child support device comprises a frame having a base for placement on a floor surface and a support section positioned above said base. A seat element is configured for receiving a toddler child in a sitting position and is coupled with the support section above the floor surface for forming a high chair. The seat element is removably mounted to the frame and is operable for being selectively removed from the support section such that the support section receives an infant child carrier for supporting an infant child carrier above a floor surface. A mounting element is positioned on the frame and engages the removed seat element for securing the removed seat element to the frame.

14 Claims, 4 Drawing Sheets

CHILD SUPPORT DEVICE WITH REMOVABLE SEAT ELEMENT

FIELD OF THE INVENTION

This invention relates to the physical support of a child support and specifically to a device for supporting children of different ages in a restaurant atmosphere.

BACKGROUND OF THE INVENTION

When families go to a restaurant or other similar facility for dining, they often include small children. The children may be small toddlers or even smaller infants. Therefore, for a pleasurable dining experience for the entire family, and particularly the adults of the party, the small children must be properly and safely accommodated at the table.

While larger children are often able to sit in regular adult chairs, some with the aid of a traditional booster seat, the smaller toddler and infant children require special arrangements. For example, traditional high chairs have long been available for toddler children who are able to sit up on their own, but who are yet too small to sit in an adult chair, even with a booster seat. Furthermore, high chairs are particularly suitable for rambunctious toddlers for whom a certain amount of containment is desired during a meal. High chairs provide certain restraints, such as belts, for a child placed therein, and therefore, provide peace of mind for the parents or caregivers during the meal. Additionally, the seating platform for the toddler child is generally smaller than in an adult chair, thereby helping the child to remain in an upright position.

While traditional high chairs have been suitable for toddler children who can sit on their own, they are entirely inadequate for infant children who do not yet have the motor skills to do so. Infants are generally brought to restaurants in an infant carrier, often referred to as a "pumpkin seat." Infant carriers usually include a cradle-shaped base for comfortably carrying or supporting the infant. A pivoting handle is attached to the base so an adult may manipulate the carrier. When dining with an infant child, parents often have to place the infant carrier and infant on the table, on a chair (if large enough) or on the floor. All of those available options for placement of the infant carrier are undesirable. Not only is the carrier exposed to the chances of falling, but oftentimes there is not sufficient table space for placing the carrier thereon. Furthermore, a chair may be too small to accommodate the carrier. Even if the chair is large enough, the awkward and cumbersome shape of infant carriers often requires that the chair and carrier be wedged against the table to ensure that the carrier does not fall off of the chair. This can present a precarious, and therefore, dangerous situation for the infant. Finally, placing the infant and carrier on a dirty, drafty restaurant floor is certainly an option to be avoided, even though it is often the safest of the available options.

One option, but one which is dangerous and discouraged or prohibited by many restaurants, is to turn a traditional high chair structure upside-down and place the infant carrier in the wide base of the chair. In doing so, the chair rests on the very narrow seat portion. Therefore, the upside-down chair is very likely to fall, which could injure a baby placed thereon. Furthermore, the restaurant could be exposed to legal liability for an injured child. While such an option is discouraged, parents will still choose to do so, and restaurants will allow them for the purposes of accommodation or lack of a more suitable option.

Attempts have also been made to develop a support device specifically for infant carriers. Many such structures are expensive and complicated and are only adapted to a specific carrier design. If a restaurant does not have a specific device for the family's infant carrier, the parents have to carry their own support device. As may be appreciated, it is very inconvenient and time-consuming to have to transport and set up such a device in a restaurant.

One type of device for supporting a variety of different infant carriers consists of a sling stretched between two support elements. The sling forms a hammock to receive the carrier. Such a device is usually suitable for the purpose of supporting the carrier above the floor, regardless of the shape of the carrier. However, such devices must be purchased and maintained by a restaurant in addition to their other separate high chair structures.

Another commercially available product purports to be suitable for both infants and toddlers. Essentially, the product is a traditional high chair which can recline for cradling an infant. However, such a product requires that the infant be removed from its carrier and placed in the plastic seat of the product. For a parent, such a scenario is not desirable. First, the plastic seat is hard and cold, and may even be dirty. Personal infant carriers usually have cushions on which the baby rests and the parents know that their carrier is clean. Therefore, the parents will be reluctant to switch the baby from their personal carrier to a public high chair device. Secondly, the infant may be nestled in blankets and other such covers, and may even be sleeping. Having to wake the infant and/or move all of the blankets to the public high chair device would further deter use of such a product. Finally, the parents or the restaurant staff are left with trying to store the bulky, empty infant carrier during the meal.

Therefore, it would seem that the only practical option is to maintain a large number of dedicated infant carrier support devices. A significant drawback, however, to any dedicated infant carrier support device, is that the restaurant must keep a number of such devices on hand, and also must obtain separate high chair structures for toddler children, and booster seats for older children. Available infant carrier support devices and high chairs are large and bulky, and therefore, require a substantial amount of floor space. While some high chair structures and infant carrier support devices are stackable, generally they are not.

Another drawback is the additional purchase and replacement costs for separate devices. However, restaurants, and particularly family-type restaurants, desire to keep their family patrons not only satisfied, but also comfortable with the thought that their children will be safe during the dining experience. Therefore, they maintain a large number of different devices to do so.

Another drawback to having a large number of dedicated support devices, is the cleaning required for such structures. Food is usually splattered all over by toddler children and may also be splattered by older infant children. Of course, parents do not want to place their child in a high chair or other device which is still dirty from the previous child. Therefore, the work loads of waitpersons, buspersons, and hosts are all increased to ensure clean high chairs and infant carrier support devices.

Therefore, it is one objective of the invention to accommodate dining families so that their children of all ages are safe and secure during the meal.

It is another objective of the invention to accommodate both toddler children and infant children during dining.

It is still another objective of the invention to reduce the costs to the restaurant owner and the workloads of the staff associated with such accommodation.

It is another objective of the invention to safely provide support to a child during a meal which is above the floor and off of the table.

Still further, it is an objective to provide such accommodation in a safe manner to reduce the liability exposure of a restaurant owner.

SUMMARY OF THE INVENTION

The above-listed objectives and other objectives are addressed by the present invention which provides a multi-purpose child support device which can accommodate both a toddler child as well as an infant child who is resting in an infant carrier. The multi-purpose child support device of the present invention secures the children of both toddler and infant age so that they are safe and secure during the meal. The child is supported above the floor and off of the table at a relatively low cost to the restaurant owner. Furthermore, since a single device is used for both toddler and infant children, the purchase and maintenance costs to the restaurant owner are reduced and the workloads of the various staff persons in the restaurant are also reduced. The safety of the device reduces the liability exposure of the restaurant owner.

The inventive child support device may be converted from a toddler mode to an infant mode and back. It includes a frame having a relatively wide base which is placed on a floor surface and a support section above the base for supporting the child. In the toddler mode, the seat element is configured for receiving a toddler child in the sitting position, and the seat element engages the support section of the frame above the floor surface for forming a high chair for a toddler child. Like a traditional high chair, the toddler child is maintained in a seated and upright position so that they may eat at a table and interact with other children and adults sitting at the table.

The inventive child support device is adaptable to the infant mode for receiving an infant child carrier when a child is too young to be able to sit up on their own in a high chair, and thus must remain resting in the infant carrier during the meal. To that end, the seat element is removably mounted to the frame and is operable for being selectively removed from the support section. The support section, in turn, is configured to receive an infant carrier when the seat element is selectively removed therefrom, and is further operable for safely supporting the infant carrier above the floor surface. The upper edge of the support section, and specifically, the upper edges of the vertical side members of the frame, have indentations formed therein or gaps. The indentations or gaps are configured for receiving handle portions of an infant child carrier to secure the carrier in the support section of the frame. When in the infant mode, horizontal cross members engage a bottom or side surface of the infant carrier for supporting the carrier or similar catching mechanism.

The frame of the device includes at least one mounting element positioned thereon and preferably three mounting knobs or track which are positioned on the frame and which engage the removed seat element to secure the removed seat element to the frame below the support section while an infant child carrier is supported on the frame support section. The seat element includes a series of apertures for receiving the mounting knobs, or grooves to receive the track, so that the seat element may hang from the frame and is readily available for re-engaging the support section after the child carrier has been removed. In that way, the device may again be utilized as a high chair. In a preferred embodiment of the invention, the mounting knobs engage the seat element so that the seat surface of the seat element is horizontal and forms a shelf for child care or other items when the support section is supporting an infant carrier. In accordance with the principles of the present invention, the device may be readily and easily converted between an infant carrier support and a high chair by the restaurant staff.

The base of the device is larger than the support section for stabilizing the frame on the ground surface. Horizontal cross members, knobs or tracks between side members of the frame in the support section engage the bottom and side surfaces of the infant carrier for supporting the carrier in an upright position when placed in the support section of the frame. The seat element includes a plurality of tracks, grooves, structural detail, etc. on the bottom surface thereof to catch and secure the seat. The tracks are operable for engaging horizontal cross members of the frame when the seat element engages the support section for securing the seat element to the frame when the support is in the high chair form.

The inventive device thus provides a single child support device which safely accommodates children of all ages, including infant children within a carrier. The safety provided by the device reduces a restaurant owner's liability exposure. Restaurants only have to purchase one device to accommodate all children and thus do not have to maintain separate infant carrier support devices as well as traditional high chairs. The inventive device provides a safe and secure place for children during dining. Furthermore, the inventive device in the infant carrier form may be utilized for supporting an infant carrier while parents wait to be seated at a table. This eliminates the need for parents to hold the heavy infant carrier for a long period of time or to place the infant carrier on a cold and dirty ground surface. Still further, a substantial amount of valuable restaurant space is conserved by eliminating separate high chair and infant carrier support devices.

BRIEF DESCRIPTION OF THE DRAWINGS

The accompanying drawings, which are incorporated in and constitute a part of this specification, illustrate embodiments of the invention and, together with a general description of the invention given below, serve to explain the principles of the invention.

DETAILED DESCRIPTION OF THE INVENTION

Figure 1:
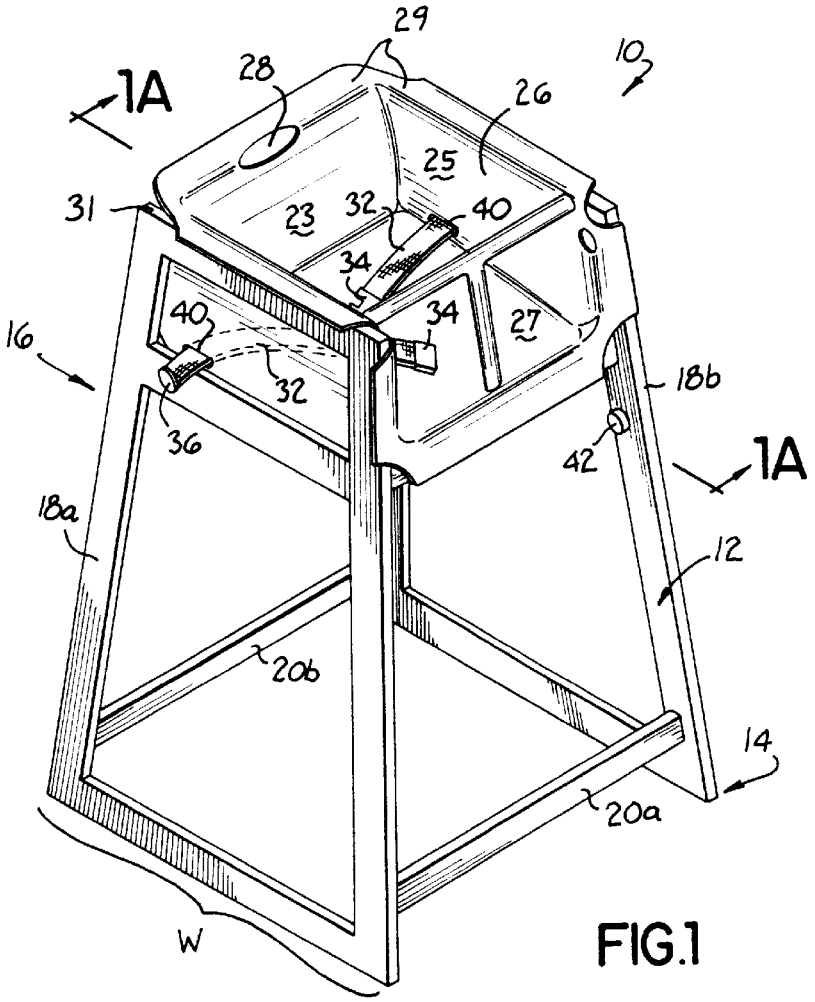
FIG. 1 is a perspective view of the inventive child support device.
Figure 2:
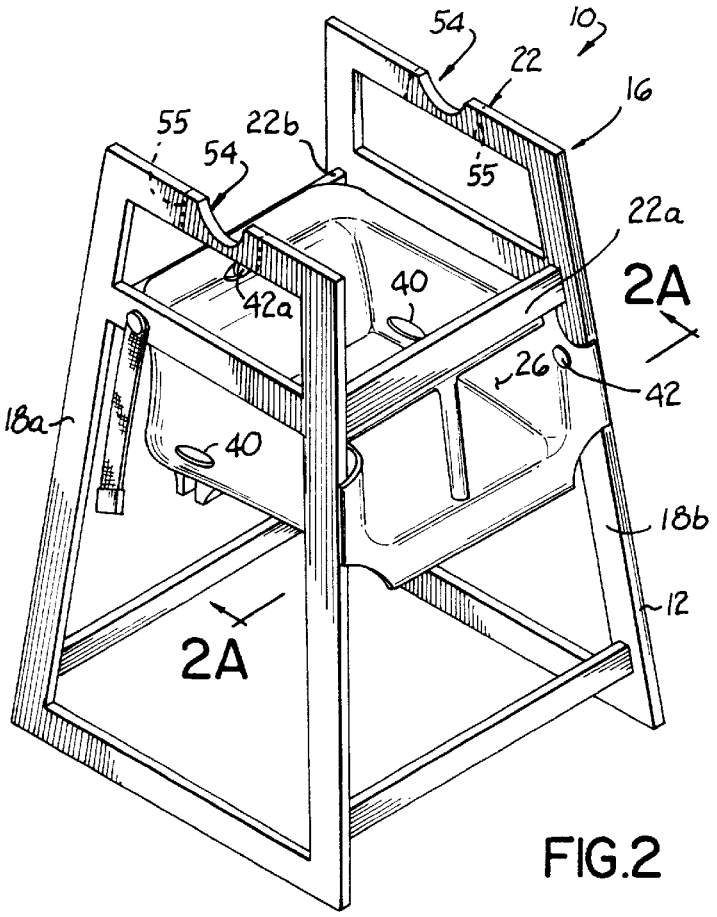
FIG. 2 is a perspective view of the inventive child support device in the infant carrier support form.
Figure 2A:
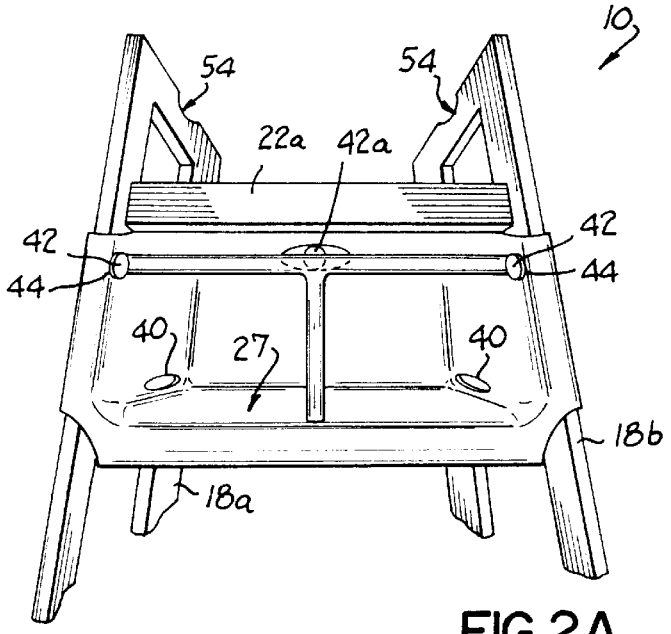
FIG. 2A is a front view of the inventive device of FIG. 2 showing the seat element of the device secured to the frame below the support section of the frame.
Figure 3:
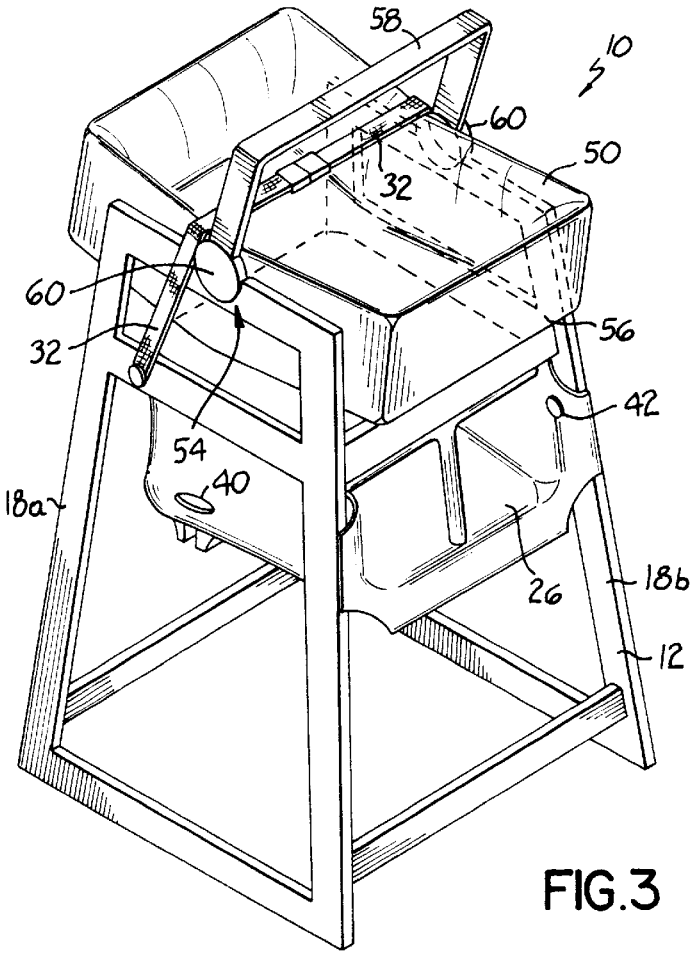
FIG. 3 is a perspective view of the inventive device shown supporting an infant carrier.

FIG. 1 shows the perspective of the child support device 10 of the invention in a high chair form or toddler mode. In accordance with the principles of the present invention, device 10 may also be converted to an infant carrier support form or infant mode as illustrated in FIGS. 2, 2A and 3. Device 10 includes a frame 12 which has a base 14 and a support section 16. The base is preferably formed of wood and includes two vertical side elements 18*a*, 18*b* which have a width W at the bottom thereof which is larger than the effective width of the top of the side elements so that the side elements generally have a triangular shape with a wider dimension proximate base 14 and a narrower dimension proximate support section 16 of the frame 12. In that way, the frame 12 is stably supported, such as on a floor surface. Frame 12 also includes horizontal cross members 20*a*, 20*b* proximate base 14 and additional horizontal cross-members 22*a*, 22*b* as illustrated in FIG. 1. The cross-members 22*a*, 22*b* form part of the support section 16 of frame 12 and support a seat element 26 or an infant child carrier as discussed further hereinbelow. The side elements taper inwardly in the direction of arrows 23 so that, in effect, the cross members 20*a*, 20*b* are longer than members 22*a*, 22*b*.

Figure 1A:
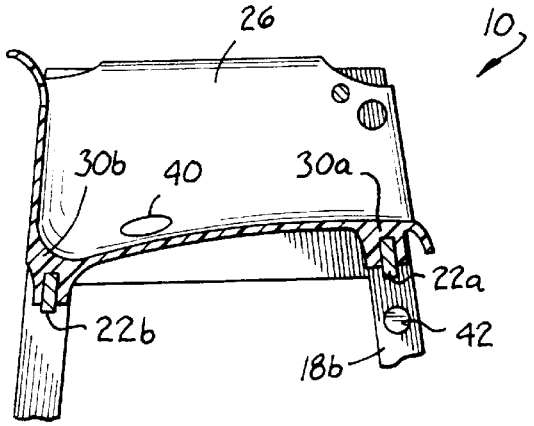
FIG. 1A is a side view of the inventive device in the high chair form.

Seat element 26, which is preferably formed of a suitable plastic material for easy cleaning, is configured for receiving a toddler child (not shown) in a sitting position. Seat element 26 engages support section 16 above a floor surface, and is supported by the support section for forming a high chair for a toddler child, as illustrated in FIGS. 1, and 1A. Seat element 26 is removably mounted to frame 12 and is operable for being selectively removed from the support section as illustrated in FIGS. 2 and 2A. The support section 16 is configured to receive an infant child carrier when the seat element is removed therefrom and is operable for supporting an infant child carrier above a floor surface, as illustrated in FIG. 3. The support section 16 of frame 12 is essentially formed by upper portions of the vertical side members 18*a*, 18*b* and the cross members 22*a*, 22*b*. Seat element 26 preferably includes a handle aperture 28 for selectively removing and replacing the seat element 26 in the support section 16.

Turning to FIG. 1A, seat element 26 includes elongated tracks 30*a*, 30*b* which preferably are integrally formed with the seat element 26 on a bottom side thereof. Of course, the tracks 30*a*, 30*b* might also be separately formed and suitably coupled to seat element 26. Tracks 30*a*, 30*b* are configured for receiving the horizontal cross members 22*a*, 22*b* respectively for securing seat element 26 to the support section 16. As illustrated in the embodiment of the invention in FIG. 1A, the cross-sectional shape of the horizontal cross members is generally rectangular, and therefore, the tracks 30*a*, 30*b* are formed in a rectangular C-shape to receive the cross members 22*a*, 22*b*. The track engagement with the cross members prevents horizontal shifting of the seat when device 10 is in the high chair form and thus secures the seat within the support section 16. Device 10 preferably includes safety straps 32 which may be coupled together with an appropriate snap or other fastener such as hook and loop fasteners. The ends of the safety straps 32 are coupled to frame 12 by an appropriate fastener 36. When a toddler child is sitting in the high chair of FIG. 1, the safety straps 32 may be fastened about their legs and/or waist to further secure the child in the seat element of the high chair. To that end, apertures 40 are formed in the seat element 26 for passage of the safety straps 32. Furthermore, as illustrated in phantom in FIG. 1, seat element 26 might include a T-bar 27 across the front thereof for further retaining a child.

Seat element 26 is preferably formed of plastic and may be readily wiped clean. The seat element has a back 23, two sides 25 and a seat surface 27 for securing a toddler child placed therein. An annular flange 29 extends around a top edge of seat element 26 and engages the top edge 31 of frame 12 to further support the seat element. Annular flange 29 might be eliminated and the seat element 26 may be secured to support section 16 through the tracks 30*a*, 30*b* only.

In accordance with the principles of the present invention, the support section is configured for receiving an infant child carrier when the seat element is removed therefrom, and the support section is operable for supporting an infant child carrier above a floor surface.

Referring to FIG. 2, seat element 26 is shown removed from the support section 16 and positioned on the frame 12 below the support section. Mounting elements 42 are positioned on the frame as illustrated in FIGS. 2 and 2A. In a preferred embodiment of the invention, the mounting elements are mounting knobs, such as wood or plastic knobs which are appropriately fastened to frame 12. Seat element 26 includes apertures formed therein for receiving the mounting knobs to secure the seat element to the frame below the support section. Mounting knobs 42 are positioned on both side elements 18*a*, 18*b* of the frame toward the front of the frame. Apertures 44 are formed in the seat element and specifically on the sides of the seat element and toward the front of the seat. To remove the seat element 26 from support section 16, the seat is lifted, such as by handle aperture 28 and is positioned below the support section 16 with the mounting knobs 42 fitting into the appropriately formed apertures 44. One of the mounting knobs 42*a* is positioned on cross member 22*b*. The handle aperture 28 receives mounting knob 42*a* for securing the seat element 26 to frame 12. As will be appreciated, an indentation or other opening (not shown) in the track 30*b* is necessary so that in the high chair form, as shown in FIGS. 1 and 1A, the track 30*b* can engage the cross member 22*b* which has mounting knob 42*a* positioned thereon.

Figure 2B:
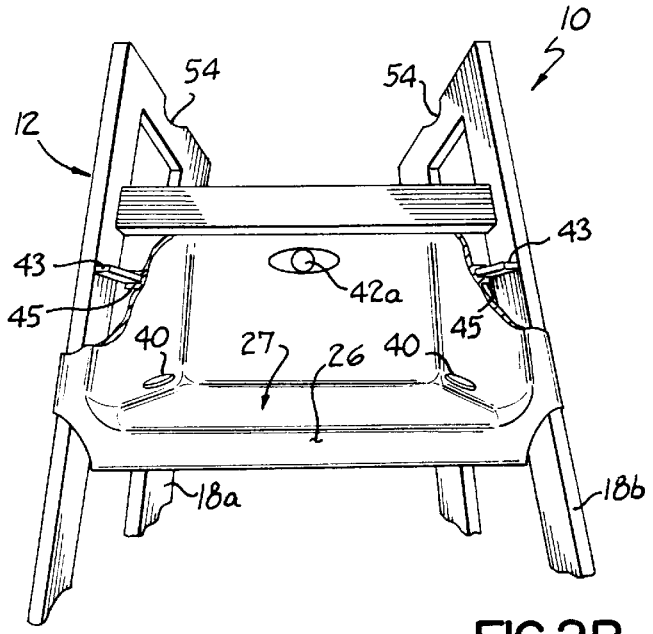
FIG. 2B is a front view similar to 2A showing an alternative means of securing the seat element of the device to the frame.

As illustrated in FIG. 2B, the frame 12 might alternatively include rails 43 in place of the knobs 42. The seat element 26 includes tracks 45 which are generally shaped and configured to engage the rails 43 to secure the seat element in position. Rails 43 might be short or could extend the entire depth of the frame. To convert the device, the seat element is removed from the support section and is slid onto rails 43.

Turning to FIGS. 2 and 2A, when seat element 26 is placed on the frame below the support section 16, the seat surface 27 is maintained generally horizontal to form a shelf for storing items, such as child care items. For example, a diaper bag or toys might be placed on the shelf when an infant carrier is positioned on frame 12 as illustrated in FIG. 3. The present invention provides a device which may be readily and easily changed between a high chair form and an infant carrier support form. Seat element 26 remains with frame 12 in either form, and thus is always available for such a conversion.

Support section 16 is essentially formed by upper portions of the vertical side members, as well as cross members 22*a*, 22*b*. Support section 16 is configured for receiving an infant child carrier 50 when the seat element 26 is removed therefrom, and is operable for supporting an infant child carrier above a floor surface (see FIG. 3). An upper edge 52 of the support section 16 formed by the vertical side members 18*a*, 18*b* includes indentations 54 formed therein for receiving handle portions of an infant child carrier to secure the carrier to the support section 16 of frame 12. Infant carriers generally include a cradle-shaped base 56 with a pivoting handle 58 for carrying the base 56. The handles are generally coupled to base 56 and the sides thereof and thus the carrier is usually widest at the position of the handle.

Furthermore, the point of attachment 60 and the pivot point for handle 58 is generally circular in cross-section. In accordance with the preferred embodiment, the indentations 54 are semi-circular for receiving pivot point 60 of carrier 50. In that way, carrier 50 is effectively prevented from inadvertently sliding forward or backward on device 10. Alternatively, the upper edge of the side members 18*a*, 18*b* may have cut-away section or cutouts 55 (in phantom) for securing a carrier, rather than the indentations. The cross members 22*a*, 22*b* support bottom and/or side surfaces of the carrier 50 and thus provide additional support for the carrier from below. The safety straps 32 may also be secured across the top of the carrier to further hold the carrier to frame 12, and the straps are preferably dimensioned for such a task. As illustrated in FIG. 3, device 10 provides a safe support device for an infant carrier with a utility shelf formed below by the removed seat element 26.

Figure 4:
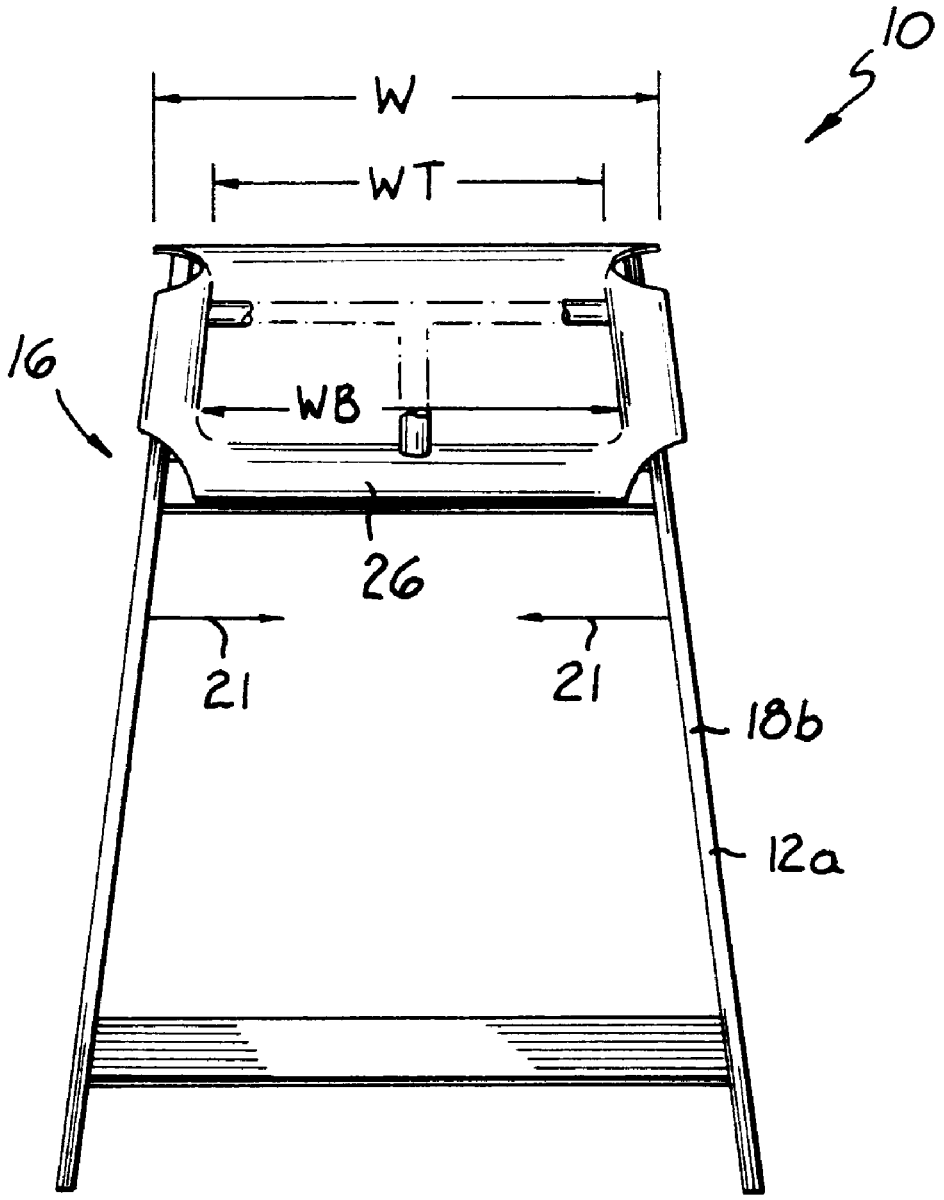
FIG. 4 is a front schematic view of the inventive device.

For easy movement of seat element 26, the seat element is preferably dimensioned to be no wider at its base than at its top. Referring to FIG. 4, a schematic front view of the invention is shown wherein the inward tilt of the side members 18A is shown along lines 21. The support section 16 of frame 12 has its narrowest or minimum width W at the top thereof due to the inward tilt of the side members 18A. The seat element preferably has a base width $W_B$ which is no greater than the top width $W_T$. The maximum width $W_T$ of the top of seat element 26 is less than width W. In that way, the seat element 26 may be easily lifted, tilted, or slid out of the support section 16 without catching on a portion of the frame 12. Of course, base width $W_B$ might be larger than the top width $W_T$, and the seat element might be slid out from the front of the support section 16. However, the former described situation is desirable to provide more flexibility in manipulating the seat.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. A multi-purpose child support device for selectively supporting a toddler child in an upright fashion or supporting an infant child carrier having a handle, the device comprising:

a frame having a base for placement on a floor surface and a support section positioned above said base;

a seat element having a seat surface and an upright back configured for receiving a toddler child in a sitting position and supporting a toddler child in an upright fashion;

the support section configured to receive and support the seat element to maintain the seat element upright back in a generally vertical orientation for forming a high chair for a toddler child;

the seat element being movably mounted to the frame and operable for being selectively displaced from the support section;

the support section being further configured for receiving an infant child carrier with the seat element displaced therefrom and operable for supporting an infant child carrier above a floor surface;

the support section including at least one vertical member with an open portion configured for containing a handle of an infant child carrier which is supported by the support section for generally securing an infant child carrier and for generally preventing it from sliding from said support section of the device;

wherein the device may be selectively utilized for supporting children of various ages.

2. The child support device of claim 1 wherein said frame support section comprises vertical side members and at least one horizontal cross member, the horizontal cross member engaging a bottom surface of an infant child carrier for supporting the carrier in an upright position.

3. The child support device of claim 1 wherein the open portion of the at least one vertical member of the support section comprises an indentation, the indentation configured for receiving a portion of a handle of an infant child carrier for generally securing a carrier to the device.

4. The child support device of claim 1, wherein the open portion of the at least one vertical member of the support section comprises a cut-away section configured for receiving a portion of a handle of an infant child carrier for generally securing a carrier to the device.

5. The child support device of claim 1 further comprising at least one mounting element positioned on the frame and configured for engaging the displaced seat element for securing the displaced seat element to the frame when an infant child carrier is supported by the frame support section.

6. The child support device of claim 5 wherein said mounting element includes a rail, the seat element including a track for engaging said rail.

7. The child support device of claim 5 wherein the mounting element engages the seat element so that the seat surface is generally horizontal to form a shelf for items when the support section supports an infant child carrier.

8. The child support device of claim 5 wherein said mounting element includes at least one mounting knob positioned on the frame, the seat element including an aperture for receiving the mounting knob to secure the seat element to the frame.

9. The child support device of claim 8 further comprising a plurality of mounting knobs, the seat element including apertures for receiving the mounting knobs to secure the seat element to the frame.

10. The child support device of claim 1 wherein said frame includes a horizontal cross member, the seat element including a track on a bottom surface thereof, the track engaging the cross member when the seat element engages the support section for securing the seat element to the frame.

11. The child support device of claim 1 wherein said base has a cross-sectional dimension larger than the cross-sectional dimension of the support section for stabilizing the frame on a ground surface.

12. The child support device of claim 1 wherein said support section has a minimum width, a widest width dimension of said seat element being less than said support section minimum width for providing easy displacement of the seat element with respect to said support section.

13. A multi-purpose child support device for selectively supporting a toddler child or supporting an infant child carrier having a handle, the device comprising:

a frame having a base for placement on a floor surface and a support section positioned above said base;

a seat element having a seat surface and a back configured for receiving a toddler child in a sifting position and supporting a toddler child in a generally upright fashion;

the support section configured to receive and support the seat element for forming a high chair for a toddler child;

the seat element being movably mounted to the frame and operable for being selectively displaced from the support section;

the support section being further configured for receiving an infant child carrier with the seat element displaced therefrom and operable for supporting an infant child carrier above a floor surface;

the support section including vertical side members for containing an infant child carrier, the side members including indentations therein, the indentations configured for receiving a portion of a handle of an infant child carrier for generally securing an infant child carrier and generally preventing it from sliding from said support section of the device;

wherein the device may be selectively utilized for supporting children of various ages.

14. A multi-purpose child support device for selectively supporting a toddler child or supporting an infant child carrier having a handle, the device comprising:

a frame having a base for placement on a floor surface and a support section positioned above said base;

a seat element having a seat surface a back configured for receiving a toddler child in a sitting position and supporting a toddler child in a generally upright fashion;

the frame support section configured to receive and secure the seat element for forming a high chair for a toddler child;

the seat element being movably mounted to the frame and operable for being selectively displaced from the support section;

the support section being further configured for receiving an infant child carrier with the seat element displaced therefrom and operable for supporting an infant child carrier above a floor surface;

the support section including vertical side members for containing an infant child carrier, the side members including cut-away sections, the cut-away sections configured for receiving a portion of a handle of an infant child carrier for generally securing an infant child carrier and for generally preventing it from sliding from said support section of the device;

wherein the device may be selectively utilized for supporting children of various ages.

* * * * *

UNITED STATES PATENT AND TRADEMARK OFFICE

CERTIFICATE OF CORRECTION

PATENT NO. : 6,010,184
DATED : January 4, 2000
INVENTOR(S) : Greg Lee and John A. Helmsderfer It is certified that error appears in the above-identified patent and that said Letters Patent is hereby corrected as shown below:

Column 3,
Line 57, delete "track" and insert -- tracks --.

Column 7,
Line 8, delete "section" and insert -- sections --.
Line 38, delete "applicant" and insert -- applicants --.
Line 42, delete "details" and insert -- details, --.
Line 46, delete "applicant's" and insert -- applicants' --.

Column 10, claim 14,
Line 1, delete "seat surface a back" and insert -- seat surface and a back --.

Signed and Sealed this

Twenty-fifth Day of December, 2001

*Attest:*

*Attesting Officer*

JAMES E. ROGAN
*Director of the United States Patent and Trademark Office*